US005310188A

United States Patent [19]

Hernberg

[11] Patent Number: 5,310,188

[45] Date of Patent: May 10, 1994

[54] GOLF CLUB SWING ALIGNMENT DEVICE

[76] Inventor: Joseph G. Hernberg, 514 Queen Anne Rd., Cherry Hill, N.J. 08003

[21] Appl. No.: 50,955

[22] Filed: Apr. 21, 1993

[51] Int. Cl.[5] ..... A63B 69/36

[52] U.S. Cl. ..... 273/186.2; 273/194 R; 273/193 A; 482/111

[58] Field of Search ..... 273/186.2, 186.3, 187.4, 273/187.5, 193 R, 194 R, 193 A; 482/109, 111; 434/252

[56] References Cited

U.S. PATENT DOCUMENTS

| | | | |
|---|---|---|---|
| 3,414,267 | 10/1966 | Engle et al. | 273/186.2 |
| 3,549,300 | 7/1967 | Pelz | 273/162 R |
| 3,565,444 | 9/1968 | La Rocca | 273/186.2 |
| 4,103,896 | 8/1978 | Lorang | 273/194 R X |
| 4,569,525 | 2/1986 | Folger | 273/81 B X |
| 4,576,378 | 3/1986 | Backus | 273/194 R X |
| 5,152,533 | 10/1992 | Radakovich | 273/194 R X |
| 5,165,683 | 11/1992 | Beutler et al. | 273/193 A X |
| 5,184,825 | 2/1993 | Ruth | 273/186.2 |
| 5,207,625 | 5/1993 | White | 273/193 A X |
| 5,228,695 | 7/1993 | Meyer | 273/187.4 |

*Primary Examiner*—George J. Marlo

*Attorney, Agent, or Firm*—Caesar, Rivise, Bernstein, Cohen & Pokotilow, Ltd.

[57] ABSTRACT

A device for providing visual feedback to the golf player of his grip during his golf stroke in maintaining proper alignment of the golf club face and the golf ball while increasing the air resistance the player encounters during the golf stroke. The device comprises a finned member for securement to the shaft of a conventional golf club adjacent the head. Certain of the fins include surfaces having visually perceptible indicia thereon, e.g., colors. The device is arranged so that one of the fins is oriented in a direction whereupon certain indicia are not visible if the club head is in a desired orientation, but will be visible if the club head is in another orientation, e.g., open or closed. The fins provide wind resistance during the swing. A weight may be secured to one of the fins.

10 Claims, 4 Drawing Sheets

GOLF CLUB SWING ALIGNMENT DEVICE

BACKGROUND OF THE INVENTION

This invention relates generally to golf swing training devices and, more particularly, to devices that can be applied to any golf club to inform the golfer of the orientation of the golf club face during the stroke.

The use of golf swing training devices has been known for a long time and the following United States Patents disclose various types of known golf club swing training devices: U.S. Pat. Nos. 3,414,267 (Engle et al.); 3,549,300 (Pelz); 3,565,444 (LaRocca); 4,103,896 (Lorang); 4,569,525 (Folger); 4,576,378 (Backus); 5,152,533 (Radakovich); 5,165,683 (Beutler); 5,184,825 (Ruth).

The apparatus disclosed by Engle et al., is a device that consists of an extension applied to the handle end of a golf club and a stand-alone, flexible rod that positions a target in front of the player. The target is vertically adjustable on the flexible rod and has a receptacle located at its center point for receiving the extension affixed to the golf club. When the player swings correctly, the player will engage the target receptacle during his downswing and will capture the target on the extension portion. Carrying away the target on the extension of the golf club following the downswing indicates to the player that his swing is correct. If the player swings incorrectly, he will simply knock the target off the flexible rod. Only when the player's wrists are cocked correctly will he engage the receptacle in the target during his downswing.

The apparatus disclosed by Pelz is a putter that enables the putter head to be aligned with the player's body during the swing. The putter shaft is designed to be attached to the forward end of the putter head, rather than near the back end of the putter head as is normally done. The putter shaft is segmented such that the player can see the top portion of the putter head when grasping the shaft. On the top portion of the putter are markings that the player visually aligns with markings on the shaft in order to achieve a desired putter inclination.

The apparatus disclosed by LaRocca is a device that attaches to the golf club near the head and which includes collapsible wings that maximally increase air resistance at the start of the golfer's downswing, but which open up and minimize air resistance just prior to golf club head impact with the ball. The LaRocca device utilizes the principle of drag to have the wing elements of the attachment oriented so that the leading edge of the wings are ninety degrees to club motion, i.e., at the maximum angle of attack. As the club is swung downward, the angle of attack is reduced so that just before impact with the ball, the leading edge of the wing is parallel to the line of flight of the club head and the ball, i.e., the angle of attack is zero degrees. Such an artificial means of increasing the golfer's speed of swing permits the golfer to train and tune his swing.

The device disclosed by Lorang attaches to the upper golf club shaft and monitors the force applied to the golf club shaft by the off-target hand, i.e., the dominant hand of the player. Usually, too much force is applied by the dominant hand of the player in swinging the golf club resulting in a poor golf stroke. The Lorang device monitors the force exerted by the off-target hand and activates some warning means (e.g., visual, audio, etc.) to the player whenever this force exceeds some predetermined threshold. Repetitive use of this device trains the player to reduce the force of his dominant hand.

The device disclosed by Folger is a non-conventional golf club consisting of four differently colored sides, including a pyramid-shaped cap with four colored sides, which correspond to different orientations of the golf club. If the player is holding and gripping the golf club in the correct position and attitude during his swing while maintaining correct body stance, he should see only one color. Any deviation from that correct grip will result in another color appearing in the player's peripheral vision and subsequently in his line of sight as the club approaches the golf ball. Also, an alignment pointer is affixed to the club head face extending perpendicularly outward to indicate the line of flight of the ball.

The device disclosed by Backus comprises an airfoil that is adjustably mounted along the club shaft and whose surface area is oriented in the plane of the face of the club head but located behind the club. As the club is swung downward, drag is created against the airfoil causing a torque to develop which tends to rotate the club in a counterclockwise direction (for a right-handed player). This rotation automatically pronates the player's hands so that the club head is at a proper angle relative to the ball when the club face strikes the ball. Removable plugs in the surface of the airfoil allow for adjusting the torque force.

The device disclosed by Radakovich is a golf club sighting device that is mounted at the tip of the club shaft, at the grip end. The sighting device has arrows indicating the target direction for the player to use. The device consists of wing-shaped member which does not fully encircle the left hand. On the upper surface of the wing are arrows and other indicators used for sighting. This particular sighting device can be substituted and/or used in conjunction with other sighting devices located along the club shaft. These other devices also have sight markings on their upper surfaces that the player uses to align his sight with. Some of these devices are contained to the tip of the golf club, fitting on the top in a cap fashion.

The device disclosed by Beutler consists of two wings hinged along the golf club shaft that collapse together during the player upswing and open up to introduce maximum drag during the player downswing. The grip of the golf club is spring loaded to maintain the wings perpendicular to the swing plane throughout the entire stroke, to maintain a counterclockwise rotational force on the golf club shaft and to restore the wings to their starting position following each stroke.

The device disclosed by Ruth is a sail that is attached to the golf club that increases the air resistance during the golf stroke. The sail is adjustably mounted to provide a resistance surface, being located over the club head/club shaft interface. A balanced mounting ensures that the sail will not rotate around the club shaft during use.

Although the aforementioned prior art devices appear suitable for their intended purposes, they nevertheless suffer from one or more of the following drawbacks: they are not suitable for use with a conventional golf club, they do not accurately simulate real world conditions, they are complex and/or are cumbersome in construction and they are not easy to use.

OBJECTS OF THE INVENTION

It is a general object of this invention to provide an apparatus which overcomes the disadvantages of the prior art.

It is another object of this invention to provide an alignment device that can be attached to any golf club.

It is still another object of this invention to provide an alignment device that can be utilized for any type of golf stroke (e.g., putting, driving).

It is still another object of this invention to provide an alignment device that is simple in construction.

It is yet another object of this invention to provide an alignment device that also increases air resistance during the golf club swing in order to develop the player's stroke.

It is still another object of this invention to provide weighted device to assist in the follow-through of the player's stroke.

SUMMARY OF THE INVENTION

These and other objects of the invention are achieved by providing a device for enabling a person to align the face of a golf club head to a desired orientation. The device comprises a member, e.g., unitary, plastic member, composed of a first, second, and third fin and a releasable securement means. The releasable securement means releasably secures, e.g., snap fits, the device onto the shaft of a conventional golf club. Each of the fins is a thin, generally planar member that extends radially outward from the hub. The first fin has a pair of sides, each of which bears first indicia, e.g., a first color, thereon. The second fin has a top surface which bears second indicia, e.g., a second color, thereon, and with the second indicia being different from the first indicia. The third fin has a top surface bearing third indicia, e.g., a third color, thereon, the third indicia being different than the first indicia and the second indicia.

When the device is secured to the club shaft in its operative orientation, the first fin projects upward, the second fin projects laterally outward of the first fin to one side of the first fin and perpendicular to this first fin. The third fin projects laterally outward of the first fin to the opposite side of the first fin, perpendicular to the first fin, and coplanar with the second fin.

BRIEF DESCRIPTION OF THE DRAWINGS

Other objects and many of the attendant advantages of the invention will be readily appreciated as the same becomes better understood by reference to the following detailed description when considered in connection with the accompanying drawings therein.

DETAILED DESCRIPTION OF THE PREFERRED EMBODIMENT

Figure 1:
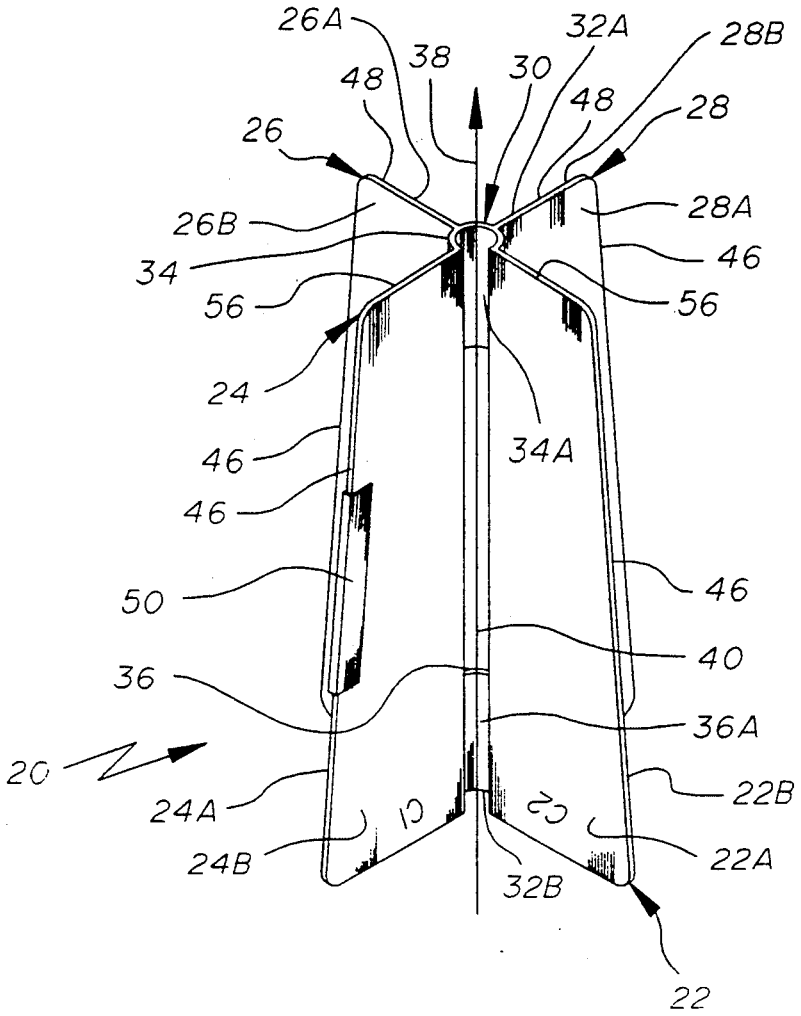
FIG. 1 is an isometric view of the golf club swing alignment device of this invention.

Referring now to the various figures of the drawing wherein like reference numerals refer to like parts, there is shown at 20 in FIG. 1 the golf club swing alignment device. The device 20 has four generally planar thin fins 22, 24, 26 and 28, each displaced ninety degrees from one another and projecting from a central hub 30. The fin 22 comprises a pair of faces 22A and 22B, the fin 24 comprises a pair of faces 24A and 24B, the fin 26 comprises a pair of faces 26A and 26B and the fin 28 comprises a pair of faces 28A and 28B. The device 20 has a top end 32A and a bottom end 32B. The hub 30 comprises a pair of spaced tubular sections 34 and 36. The section 34 forms the "upper shaft tube," while the section 36 forms the "bottom shaft tube." The sections 34 and 36 include entrance slots 34A and 36A, respectively. The four fins 22, 24, 26 and 28 are joined at to the upper shaft tube 34 at the top end of the device and to lower shaft tube 36 at the bottom end of the device.

Figure 2:
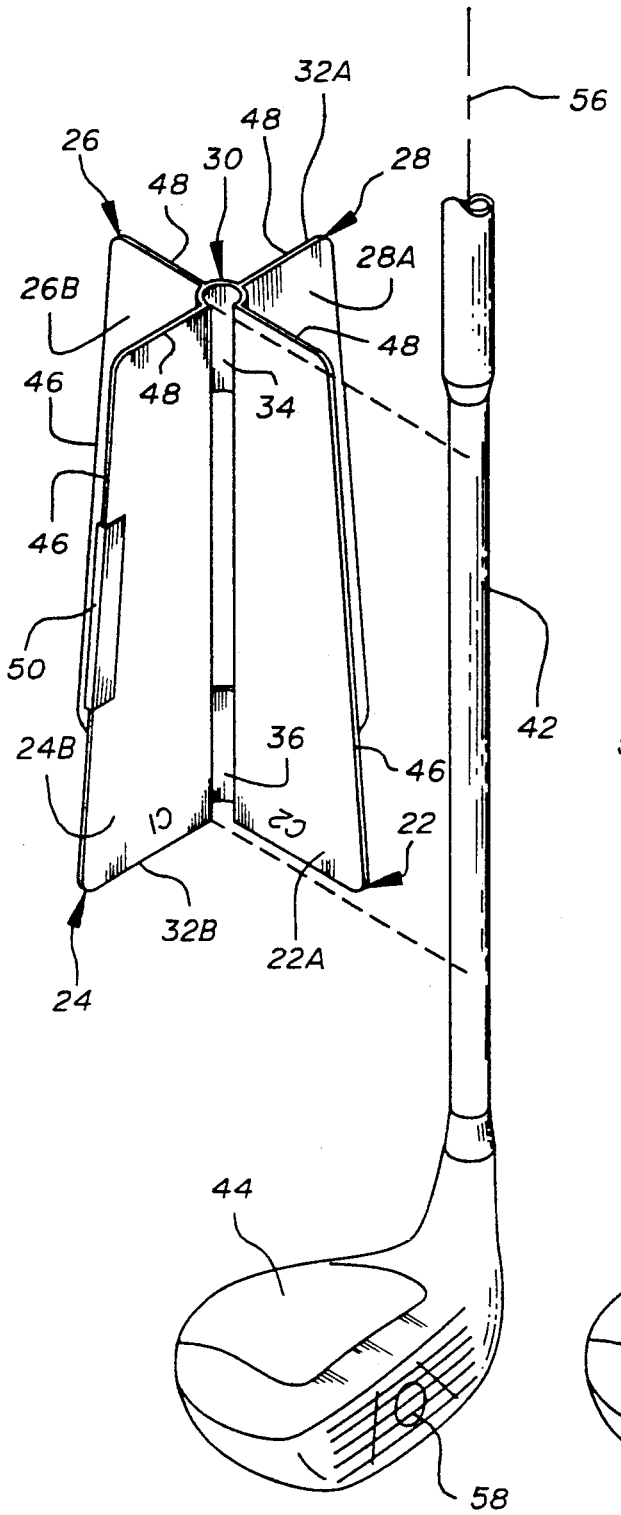
FIG. 2 is an exploded isometric view showing how the device is oriented to be placed onto the shaft of a conventional golf club.
Figure 3:
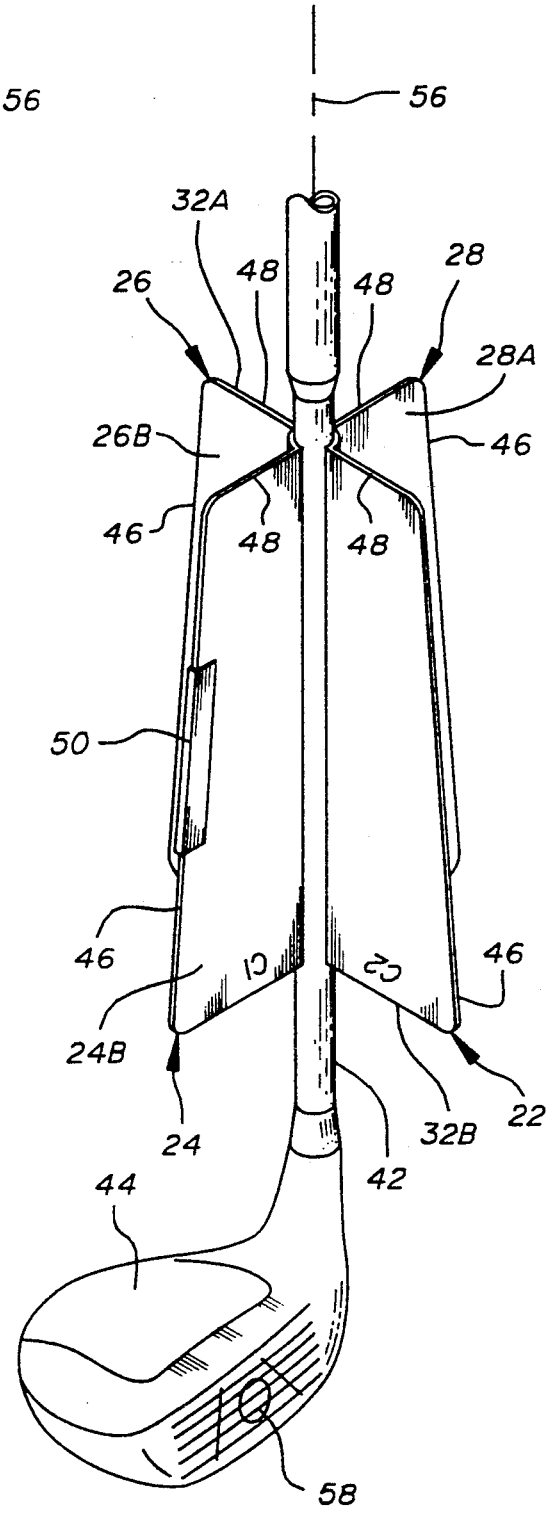
FIG. 3 is an isometric view showing the device on the shaft of the golf club.

The upper shaft tube 34 and the lower shaft tube 36 are axially aligned with one another along a central longitudinal axis 38 such that the shaft 42 of a conventional golf club can be inserted through the entrance slots 34A and 36A into the tubes, as shown in FIG. 2. The respective diameters of upper shaft tube 34 and lower shaft tube 36 restrict the mounting position of device 20 to the lower portion of shaft 42 and also ensure that the bottom end 32B is always mounted near the club head 44 of the golf club as shown in FIG. 3.

Figure 4:
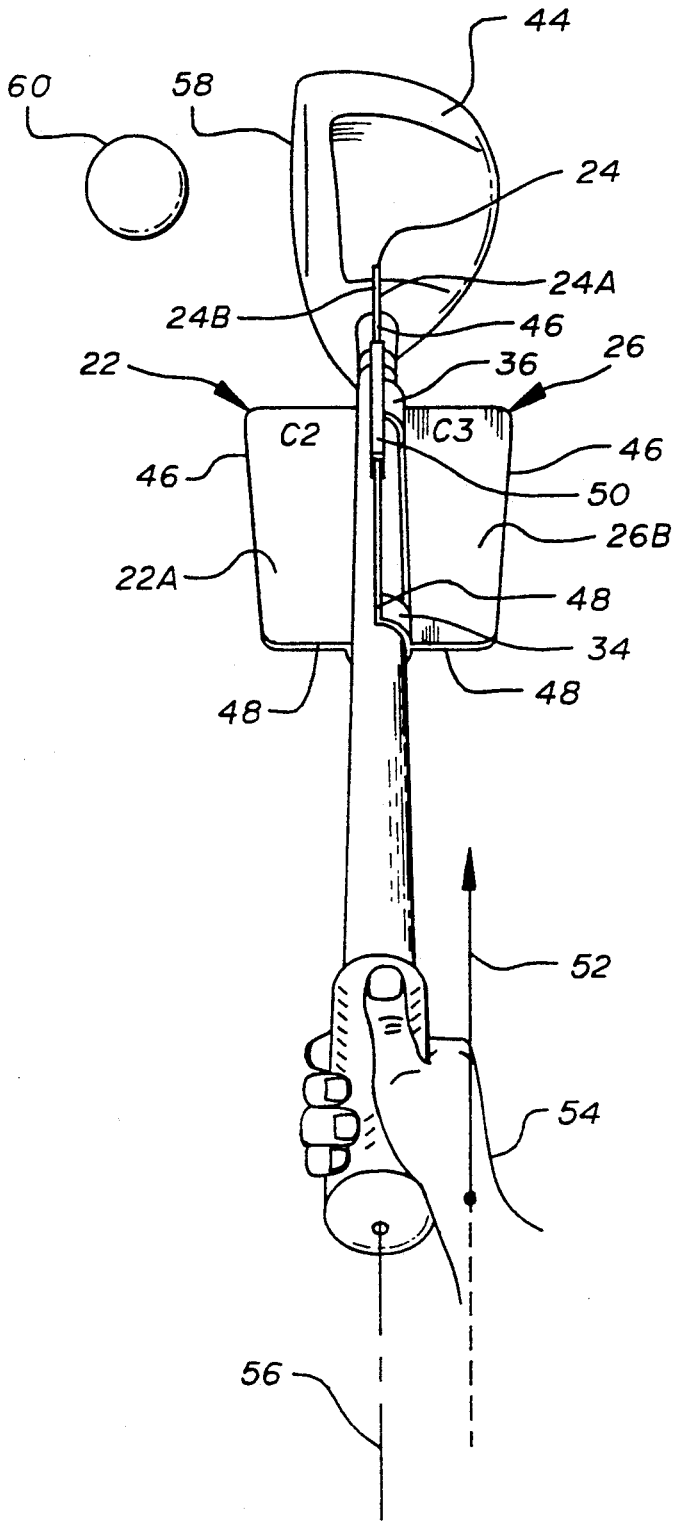
FIG. 4 is a top plan view from the player's perspective showing the device in position when the club is about to strike a golf ball.

Each fin has an outer edge 46 that is tapered, i.e., the edge 46 slopes outward from the top end 32A down to the bottom end 32B. The tapered edges 46 enhance player visualization by leading the player's sight lines across the width of club head 44, as shown in FIG. 4. Each fin also has a top edge 48.

Once the device 20 is mounted on club shaft 42, the device 20 can be rotated so that a particular fin 22, 24, 26 or 28 can be situated in front of the player, along the shaft 42. In accordance with a preferred aspect of this invention certain of the fins include indicia thereon to enable the user to correctly align the golf club head. In particular, both of the surfaces 24A and 24B of the fin 24 are of a first color, e.g., red. This red color indicia is denoted by the designator C1 in the drawings. The surface 22A of the fin 22 is of another color, e.g., green. This green color indicia is denoted by the designator C2 in the drawings. The surface 26B of the fin 26 is of yet another color, e.g., yellow. This yellow color indicia is denoted by the designator C3 in the drawings.

It must be pointed out at this juncture that the indicia colors C1, C2, and C3 may comprise the entire surface of the associated fin or only a portion thereof. Moreover, other colors may be selected for any of the surfaces. However, it is preferable that the surfaces 24A and 24B each be of the same color and the surfaces 22A and 26B be of another color or other colors. In fact, the indicia C1, C2, and C3 need not be colors at all, but can be shapes, letters, numbers, etc., provided that they can be readily visually distinguished from each other by the user of the device.

The device 20 is arranged so that when it is mounted on the shaft of the golf club in the desired operative position, the fin 24 is oriented such that the only portion of that fin 24 that is visible to the player holding the golf club in a conventional manner to address the golf ball from the perspective of that player is the outer edge 46 and top edge 48, as shown clearly in FIG. 4. As mentioned earlier, the faces 24A and 24B are each colored red. If the player is maintaining the correct grip during his stroke, such as shown in FIG. 4, his wrists will not be cocked (rotated about an axis 52 normal to the side of a right-handed player's wrist 54) nor twisted (rotated about the golf club shaft axis 56) and the golf club face 58 will strike the golf ball 60. In such a club orientation, the only portion of the fin 24 that the player will see is the outer edge 46 (including a weight 50-to be discussed later) and top edge 48 of that fin. Both of the edges 46 and 48 will be aligned with the longitudinal axis of the golf club shaft 42. As long as the player maintains this correct grip, the player should never see any "red" color throughout his stroke. However, if the player ever rotates his wrists 54 about the axis 52 or twists his wrists 54 about shaft axis 56 or both, either face 24A or 24B will become visible, if only in part (e.g., the sighting of a red color), to the player and the player can instantly correct for such misalignment. Moreover, the red that the person sees will be immediately adjacent either the green surface 22A of fin 22 or the yellow surface 26B of fin 26. Thus, the player can readily determine the direction of misalignment, i.e., whether the club face is "open" or "closed" so that correct alignment, if desired, can be expected. Furthermore, this device allows the more experienced player to develop the use of an "open" or "closed" orientation of the golf club face 58. In this case, the more experienced player prefers to see a certain amount of red in combination with either a yellow or green color, depending on whether he is attempting to improve his grip in effecting an "open" or a "closed" orientation.

Figure 5:
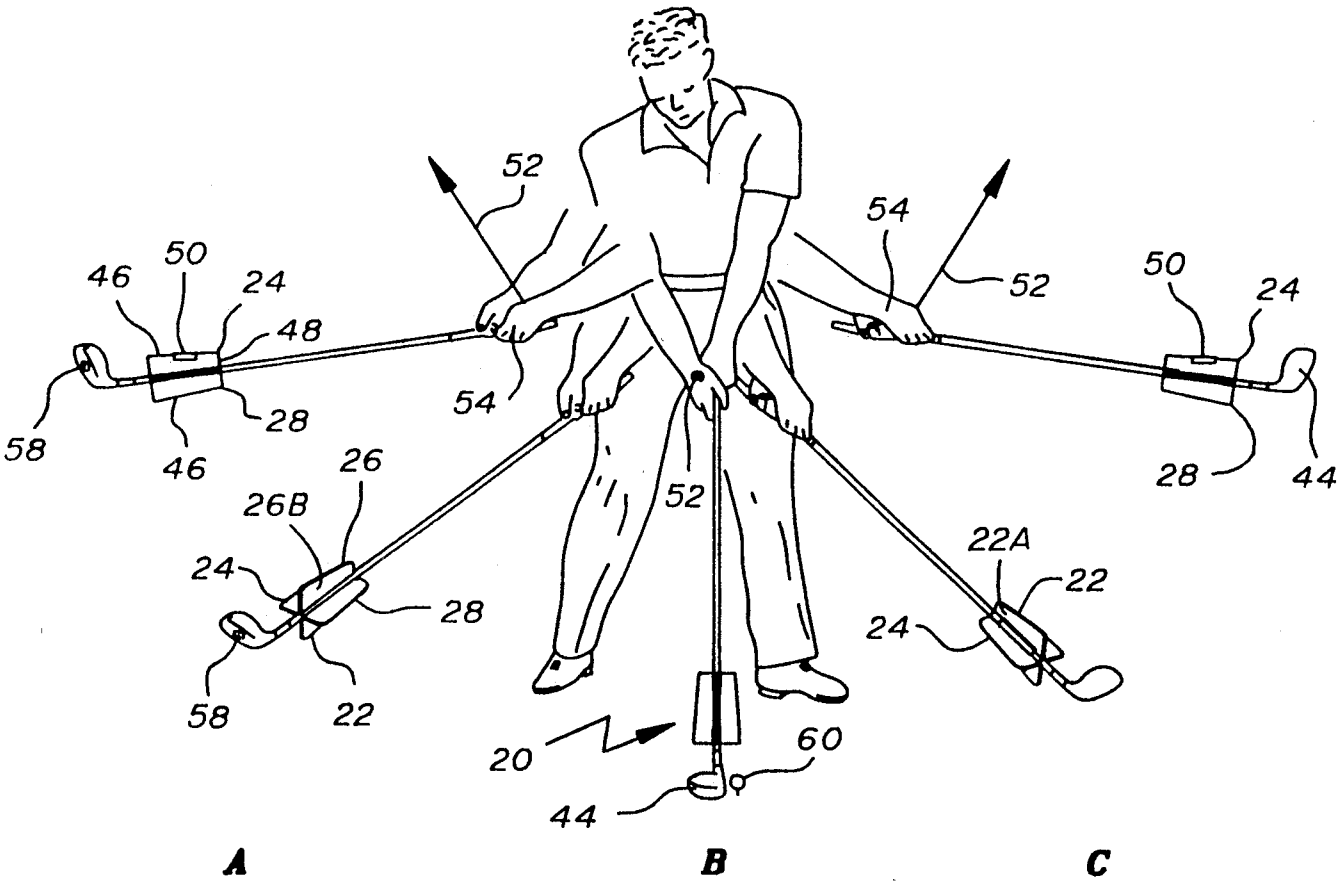
FIG. 5 is a front elevated view showing the functional range of the device during the player's stroke.

FIG. 5 shows different phases of the player's stroke, three of which are within the player's direct line of sight. Phase A is the approach portion of the stroke prior to impact with golf ball 60. Phase B is the impact portion of club head 44 with golf ball 60. Phase C is the follow-through portion of the stroke. During all three of these phases the player wants to be aware of his grip orientation in order to be able to eliminate any rotation or twisting of his wrists 54. With device 20 correctly mounted on the shaft 42, the player can readily determine in correct alignment by seeing "red" and can determine the direction of the misalignment by the other color visible during any of these three phases. Thus, if desired, the player can orient his wrists 54 to eliminate the red color and thereby align club head face 58 to strike golf ball 60 squarely and/or to ensure correct follow-through. In particular, if the player's wrist 54 orientation is incorrect as the golf club 42 approaches the ball 60 during phase A, the color red on fin 24 will be visible to the player. The player can make an immediate correction by turning or twisting his wrists 54 to re-orient the club such that any red color is eliminated from his sight. By the time the player reaches phase B of the stroke the player should see no red color as club head face 58 impacts golf ball 60. To ensure that he is maintaining his correct grip, the player should see no red color during his follow-through shown in phase C. FIG. 5, phase C depicts an incorrect grip during follow-through. In such a case, the player would see red, indicating a rotation or twisting of his wrists during follow-through. The player, now aware of his tendency to rotate his wrists during follow-through, can make an effort to maintain a correct grip for subsequent strokes.

Device 20 can be used during any type of golf stroke, putting, driving, etc., with any type of club.

As should be appreciated the projecting fins of the device 20 act to increase air resistance throughout the golf stroke, and thereby strengthen the player's stroke.

In accordance with one preferred embodiment of the device 20, a weight (e.g., lead) 50 may be affixed to fin 24 along the outer edge 46 to assist the player in maintaining the orientation of his wrists 54 and to aid in completing the player's swing. This weight 50 may span the entire outer edge 46 or may be concentrated at one location along the edge 46, as shown in FIGS. 1-5.

Without further elaboration the foregoing will so fully illustrate my invention that others may, by applying current or future knowledge, adopt the same for use under various conditions of service.

I claim:

1. A device for enabling a person to align the face of a golf club head to a desired orientation, said device comprising first, second, and third fins, a hub, and releasable securement means, said releasable securement means for releasably securing said device to the shaft of a conventional golf club, each of said fins being a thin, generally planar member extending radially outward from said hub, whereupon when said device is secured to said club shaft said first fin projects upward, said second fin projects laterally outward of said first fin to one side of said first fin and perpendicular to said first fin, and said third fin projects laterally outward of said first fin to the opposite side of said first fin, perpendicular to said first fin, and coplanar with said second fin, said first fin having a pair of sides each of which bears first indicia thereon, said second fin having a top surface bearing second indicia thereon, said second indicia being different than said first indicia, said third fin having a top surface bearing third indicia thereon, said third indicia being different than said first indicia.

2. The device of claim 1 wherein said first indicia comprises a first color, and said second and third indicia being a different color than said first color.

3. The device of claim 2 wherein said second indicia is a second color and said third indicia is a third color, said second and said third colors being different from each other and from said first color.

4. The device of claim 3 wherein said releasable securement means comprises a central hub from which said fins project and having a longitudinal slot extending therethrough for receipt of a portion of said golf club shaft therein.

5. The device of claim 3 additionally comprising a weight element attached to said first fin, said weight element aiding in maintaining the orientation of the person's wrists and assisting in completion of the golf stroke by said person.

6. The device of claim 5 wherein each of said fins is

7. The device of claim 3 wherein each of said fins is tapered to enhance the person's visualization of the golf club head.

8. The device of claim 1 wherein said releasable securement means comprises a central hub from which said fins project and having a longitudinal slot extending therethrough for receipt of a portion of said golf club shaft therein.

9. The device of claim 1 additionally comprising a weight element aiding in maintaining the orientation of the person's wrists and assisting in completion of the golf stroke by said person.

10. The device of claim 1 wherein each of said fins is tapered to enhance the person's visualization of the golf club head. tapered to enhance the person's visualization of the golf club head.

* * * * *